US005373828A

United States Patent [19]

Askew et al.

[11] Patent Number: 5,373,828

[45] Date of Patent: Dec. 20, 1994

[54] FUEL INJECTION SYSTEM

[75] Inventors: James M. A. Askew; Alan G. Jones; Andrew J. Lilley; Goulielmos Vranas, all of Gloucester, United Kingdom

[73] Assignee: Lucas Industries Public Limited Company, Solihull, United Kingdom

[21] Appl. No.: 944,789

[22] Filed: Sep. 15, 1992

[51] Int. Cl.[5] ..... F02M 37/04

[52] U.S. Cl. ..... 123/506; 123/458

[58] Field of Search ..... 123/506, 458, 467, 446, 123/495, 500, 501

[56] References Cited

U.S. PATENT DOCUMENTS

| | | | |
|---|---|---|---|
| 4,129,256 | 12/1978 | Bader | 123/506 |
| 4,422,424 | 12/1983 | Luscomb | 123/458 |
| 4,531,672 | 7/1985 | Smith | 123/446 |
| 4,653,448 | 3/1987 | Ohmori | 123/458 |
| 4,653,455 | 3/1987 | Eblen | 123/458 |
| 4,969,600 | 11/1990 | Nicol | 123/458 |
| 4,997,345 | 3/1991 | Dahlmann | 123/506 |
| 5,076,241 | 12/1991 | Takahashi | 123/506 |

FOREIGN PATENT DOCUMENTS

| | | | |
|---|---|---|---|
| 2348865 | 4/1975 | Germany | 123/506 |

*Primary Examiner*—Carl S. Miller

*Attorney, Agent, or Firm*—Jacobson, Price, Holman & Stern

[57] ABSTRACT

A fuel system for a multi-cylinder compression ignition engine includes a tubular body (10) having an internal step (11) against which is located a flanged pump barrel (12), a pair of valve blocks (22, 23) mounted in end to end relationship between the barrel (12) and a mounting block (24) secured to the body by bolts (25) which provide a clamping force which ensures a liquid tight seal between the engaging end faces of the blocks and the barrel. A bore (14) in the barrel (12) houses a pumping plunger (15) and the valve blocks house a delivery valve (41) and a spill valve (26), respectively. The spill valve is controlled by an electromagnetic valve (30) mounted on the mounting block.

10 Claims, 2 Drawing Sheets

FUEL INJECTION SYSTEM

BACKGROUND OF THE INVENTION

This invention relates to a fuel injection system for supplying fuel to an internal combustion engine of the compression ignition type and having for each cylinder of the engine, a fuel injection nozzle, a reciprocable plunger cam actuated pump which can supply fuel under pressure to the nozzle during inward movement of the plunger in a bore in a pump body, an electromagnetically operable valve means which when closed prevents the spillage of fuel from the bore and a control unit for the valve.

BRIEF SUMMARY OF THE INVENTION

The object of the present invention is to provide such a system in a simple and convenient form.

According to the invention in a fuel injection system of the kind specified each pump comprises a generally tubular body, a flanged pump barrel located against a step defined in the body, a bore formed in the barrel, a pumping plunger slidable in the bore and extending from one end thereof, first and second valve blocks located within the body, a mounting block extending within the body, means for securing the mounting block to the body so as to generate a clamping force between the presented surfaces of the barrel, the valve blocks and the mounting block, the valve blocks housing a spill valve and a delivery valve respectively, an electromagnetically operable valve carried on the mounting block, controlling the operation of the spill valve, an outlet on the mounting block, communicating with the bore through a fuel delivery channel in which the delivery valve is located, resilient means for biasing the plunger outwardly of the bore, means for supplying fuel to the bore during the outward movement of the plunger and means engageable with the plunger for effecting inward movement thereof.

According to a further feature of the invention the delivery valve is located in the second valve block and the fuel delivery channel includes a passage in the first valve block.

According to a still further feature of the invention the delivery valve and the spill valve are located in drillings formed in the respective valve blocks, the drillings being offset from the axis of the plunger, each valve block being provided at one end with a cylindrical portion the axis of which coincides with the axis of the drilling formed in that block.

According to another aspect of the invention the control system includes a drive unit for the electromagnetic valve means, the drive unit including look-up maps in which is stored data representing the operational times of the electromagnetic valve means and spill valve whereby the operating delays which may vary in accordance for example with temperature, can be compensated.

BRIEF DESCRIPTION OF THE DRAWINGS

An example of a fuel system in accordance with the invention will now be described with reference to the accompanying drawings wherein.

DETAILED DESCRIPTION

Figure 1:
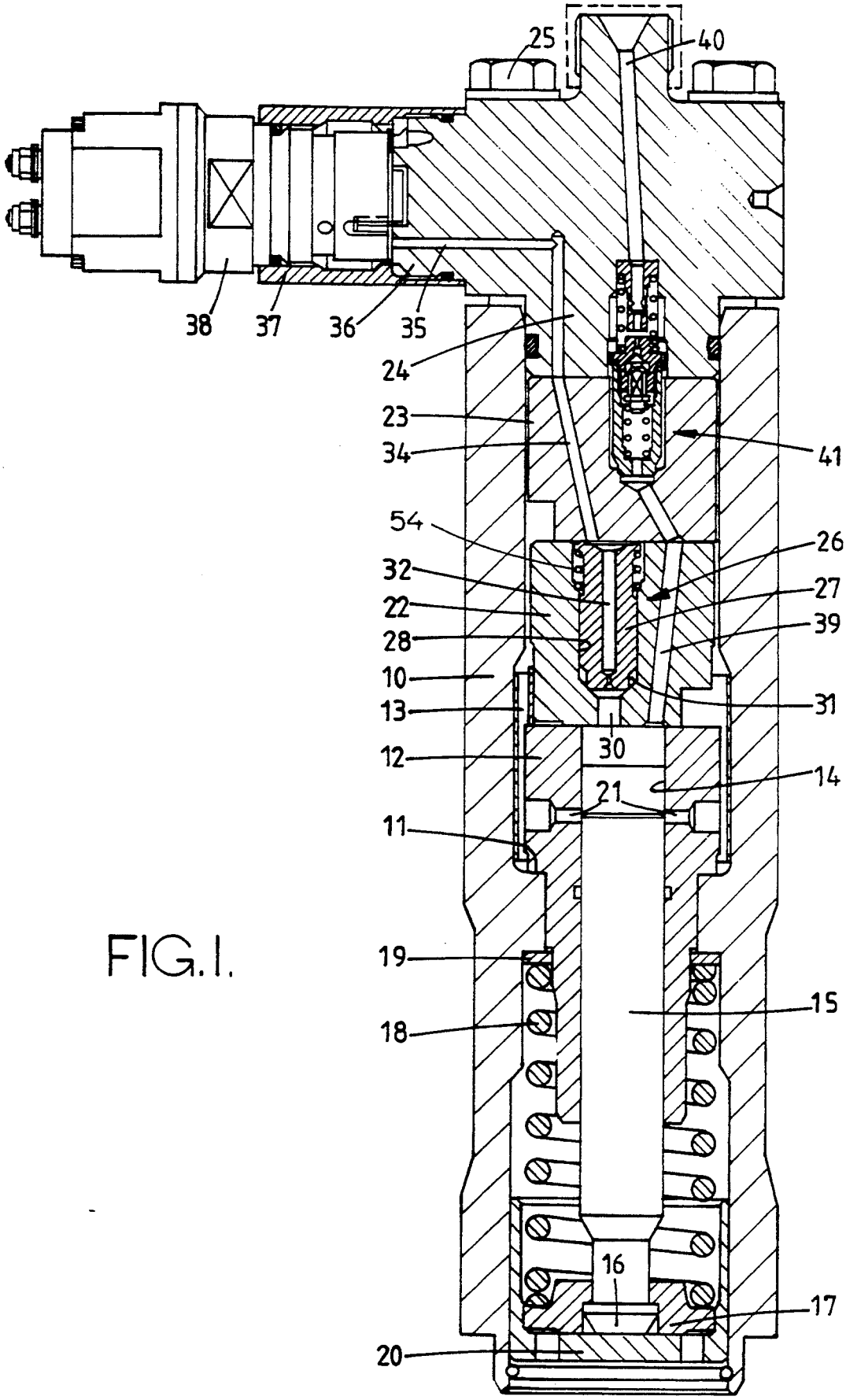
FIG. 1 is an axial cross sectional view of the pump.

Referring to FIG. 1 of the drawings the pump comprises a generally tubular body 10 and located against an annular step 11 in the body is a complementary step defined by a flanged portion of a pump barrel 12. Surrounding the flanged portion of the barrel is an annular chamber 13 which communicates with a fuel inlet (not shown) formed in the pump body. The chamber is also provided with anti-erosion baffles. Within the barrel there is formed a bore 14 and slidable within the bore is a pumping plunger 15. The plunger extends from the bore and is provided with a head 16 with which is engaged a spring abutment 17. Engaged with the abutment 17 is one end of a coiled compression spring 18 the opposite end of which abuts against a shim 19 which is interposed between the spring and a further step defined in the body. The interior surface of the body in the region of the spring abutment is machined to form a bearing surface for a cup shaped tappet 20 which engages with the head 16 of the plunger. The tappet is retained within the body in known manner, by means of a circlip and in use, is urged inwardly by an engine driven cam. The plunger is shown in its outermost position and in this position the end of the plunger remote from the head uncovers a pair of inlet ports 21 which communicate at their outer ends, with the annular space 13. The ports 21 are covered during the initial inward movement of the plunger.

Also provided is a pair of valve blocks 22, 23, which are located in end to end relationship with the first valve block 22 being in engagement with the end surface of the pump barrel. The first block 22 is held in sealing engagement with the adjacent end face of the pump barrel and with the adjacent face of the second valve block 23 by means of a mounting block 24 which has a portion located within the body 10 and defining an end surface for sealing engagement with the adjacent end surface of the valve block 23. The mounting block is secured by means of bolts 25 to the body 10 and the action of tightening the bolts produces a clamping force which provides the required liquid seal between the adjacent contacting surfaces of the mounting block, the valve blocks and the pump barrel. The mounting block and the valve blocks can be secured together by screws to facilitate assembly.

The first valve block 22 houses a spill valve generally indicated at 26 and this takes the form of a valve member 27 slidable axially within a drilling 28 extending inwardly from the end face of the valve block which is engaged by the valve block 23. At its inner end the drilling defines a seating 29 about a spill passage 30 which communicates with the adjacent end of the bore 14. The valve member at its end adjacent the seating is of reduced diameter so as to define an annular space 31 which communicates with the chamber 13 by way of a passage formed in the valve block and which is a continuation of the spill passage 30. The end of the valve member is shaped to cooperate with the seating. Within the valve member and extending inwardly from the end of the valve member remote from the seating is an axial passage 32 which terminates in a restriction through which the passage communicates with the spill passage 30. At the end of the valve member remote from the restriction the opening of the passage is flared so as to afford permanent communication with a passage 34 which is formed in the valve block 23. The passage 34 communicates with a further passage 35 formed in the mounting block 24 and which opens onto the end surface of a peripherally screw threaded spigot 36 machined on the mounting block. The spigot carries a sleeve 37 into which is screwed the body of an electromagnetically operable valve 38. The valve is such that when electric current is supplied to the solenoid thereof, the passage 35 is closed and when the solenoid is de-energized, the passage is connected to a fuel drain.

Also formed in the first valve block 22 is a passage 39 which forms part of a fuel delivery channel which terminates in an outlet 40 formed on the mounting block 24. The outlet 40 in use, is connected to a fuel injection nozzle of the associated engine.

Figure 2:
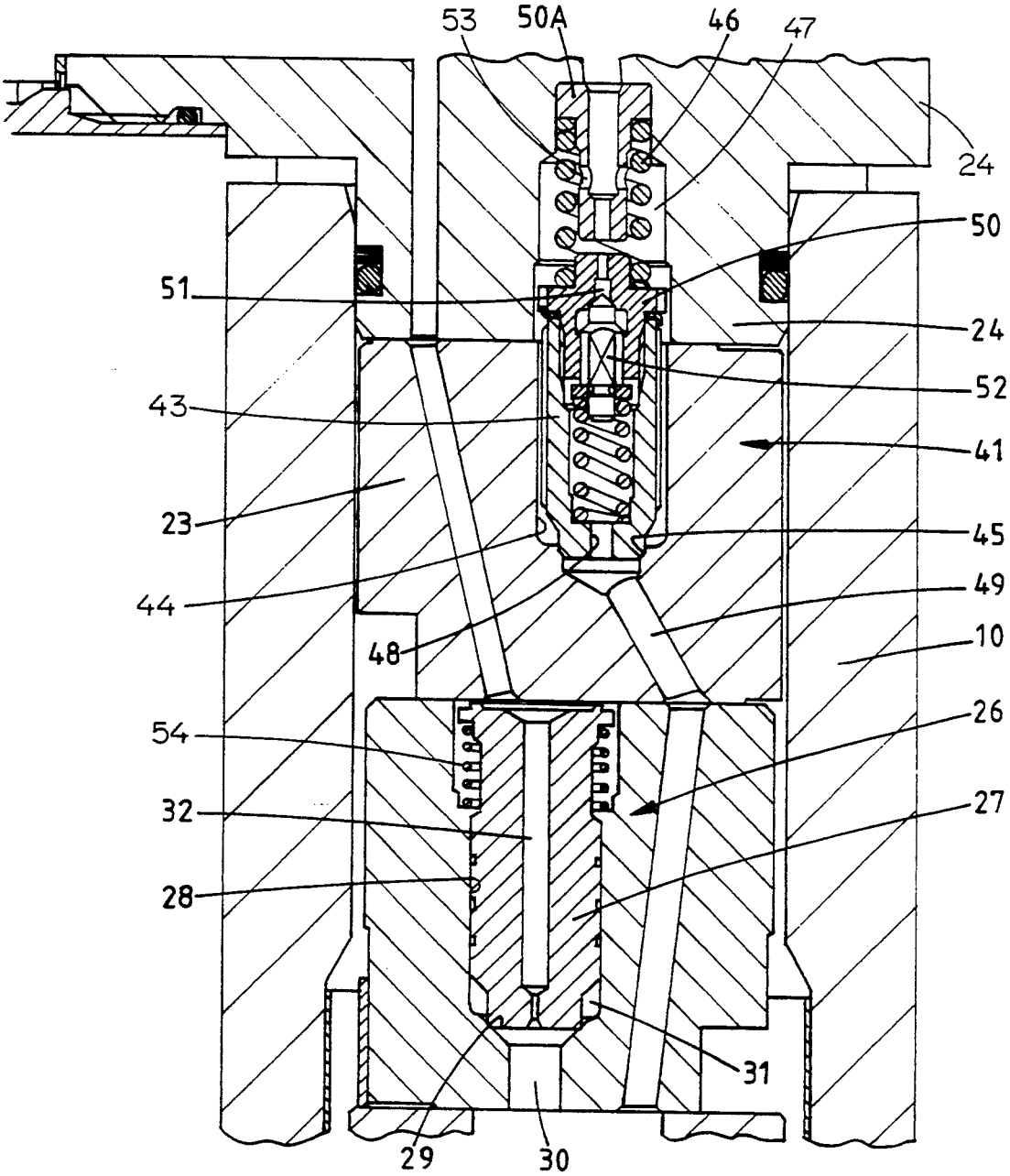
FIG. 2 is a cross sectional view on an enlarged scale of part of the pump which is seen in FIG. 1.

Located in the fuel delivery channel is a delivery valve generally indicated at 41 in FIG. 1 and which is shown on a substantially enlarged scale in FIG. 2. The delivery valve comprises a valve element 43 which is provided with longitudinal flutes on its external surface whereby the valve element is guided in a bore 44 formed in the valve block 23. The valve element is biased into engagement with a seating 45 by means of a coiled compression spring 46 which conveniently is housed within a chamber 47 formed in the mounting block 24. The valve element 43 is of hollow cup shaped form and formed in the base thereof is an opening 48 through which the interior of the valve member is in permanent communication with a passage 49 upstream of the seating 45, the passage 49 communicating with the passage 39 in the valve block 22. Within the open end of the valve member there is located a valve housing 50 in which is formed a drilling 51 at the inner end of which is a seating for a spring loaded valve 52, the valve 52 being fluted. The valve housing 50 may be in screw thread engagement with the valve element 43 and it forms an abutment for the spring 46. The opposite end of the spring 46 engages a step defined on a stop member 50A which is located in the chamber 47 and which serves to limit the extent of movement as will be described, of the valve element 43. The stop member defines a central passage having in addition side entries 53, this passage forming part of the fuel delivery channel.

The operation of the pump will now be described from the point at which the plunger 15 is moved inwardly from the position shown in FIG. 1 by the engine driven cam. During the initial inward movement of the plunger fuel will be displaced from the bore through the ports 21 but as soon as these ports are covered, fuel will be displaced from the bore through either the spill passage 30 or the fuel delivery channel 39 depending upon whether the spill valve 26 is in the open or the closed position. If the spill valve is in the open position, fuel will flow through the spill passage 30 into the chamber 13 which is connected to a source of fuel under pressure. Some flow of fuel will occur into the passage 32 by way of the restrictor but such fuel will flow to drain by way of the open electromagnetically operable valve 38. If the valve 38 is energized the flow of fuel through the passage 32 will be prevented and this will cause a build up of pressure in the end portion of the cylinder 28 remote from the seating 29. The build up of pressure in view of the fact that there will be a pressure difference between the fuel in the spill passage 30 and the fuel in the chamber 13, will result in the valve member 27 moving into engagement with the seating 29 and when this occurs further flow of fuel through the spill passage 30 is prevented. The fuel therefore must flow through the fuel delivery channel towards the fuel injection nozzle. The result will be that the valve element 43 of the delivery valve will be lifted from its seating to permit such flow and this flow will continue so long as the plunger is being moved inwardly by the cam and the spill valve is in the closed position.

If while the plunger is moving inwardly, the electromagnetically operable valve 38 is de-energized, the fuel pressure at the end of the cylinder 28 connected to the valve 38 will fall and the high pressure within the bore will cause the spill valve to be lifted from its seating to allow fuel to spill from the bore along the spill passage 30. The reduction in pressure will permit the valve member in the fuel injection nozzle to close and also will allow the delivery valve element 43 to move into engagement with the seating 45. A reverse flow of fuel from the pipeline which connects the pump with the nozzle may occur, such reverse flow being controlled by the valve 52 which can be set so that a predetermined pressure is maintained in the pipeline, the pressure being less than the pressure required to open the valve member of the nozzle.

It will be appreciated that the closure of the electromagnetic valve 38 whilst the plunger is moving inwardly determines the instant of fuel delivery to the associated engine and the length of time considered in terms of engine crankshaft rotation during which the valve is closed, determines the amount of fuel which is supplied to the engine.

As seen in the drawings, a light spring 54 is provided to bias the valve member 27 of the spill valve to the open position. However, this is not essential and the valve will function as described, without the spring. Moreover, as described the delivery valve 41 is a pressure unloading valve. However, by providing a collar on the skirt of the valve element 43 a volume unloading valve is obtained. The collar may be a close sliding fit with the wall of the bore 44 in which case it will be exposed beyond the end of the bore when the delivery valve is in the fully open position. The collar may however have a clearance with the bore in which case it may not be moved beyond the end of the bore.

As shown in FIG. 1 the axes of the bores 28 and 44 which house the spill valve, and the delivery valve respectively, are offset from the axis of the bore 14. The machining of the bores 28, 44 is facilitated by the fact that the end portions of the valve blocks remote from the open ends of the bores are of cylindrical form and have their axes coinciding with the longitudinal axes of the respective bores.

The pump is mounted on the engine by means of a pair of mounting lugs integrally formed with the lower end of the pump body 10 at a position so that the tappet 20 can be engaged conveniently by a member which is driven by an engine driven cam.

The system includes a fuel injection nozzle (not shown). The nozzle is a conventional nozzle having an inwardly opening valve member housed within a nozzle body, the valve member being biased by means of a spring to the closed position and being moved to the open position by means of fuel under pressure delivered by the pump. The nozzle body is mounted at the end of a holder which defines a chamber housing the spring which biases the valve member. An intermediate piece may be located between the nozzle body and the end of the holder and a cap nut of conventional construction is utilized to retain the nozzle body relative to the holder.

The supply of electric current to the solenoids of the valves 38 is effected by means of a drive unit (not shown). The drive unit includes a power pack which ensures that the solenoids will be energized from a constant voltage source and a switching unit which includes semiconductor drive elements connected in series with the solenoids respectively. The flow of current in the drive elements is controlled so that the initial flow of current rises at a high rate to a value which may be maintained by a switching action and is then reduced to a lower value to hold the valves in the closed position. Provision is made to monitor the current flowing in the solenoids and also to check the operation of the valves. The period of time required for the valves 38 to move to the closed position or what can be regarded as the closed position together with the subsequent operation of the associated spill valves and other factors such as the time taken for the pressure wave to reach the injector, constitute a real time delay which must be taken into account when injection of fuel is required at a particular point in the engine operating cycle. The delay in terms of degrees of engine crankshaft rotation varies with the engine speed but in addition the delay can vary with for example temperature. Maps are provided in the drive unit so that the delay can be determined, the maps containing data obtained as a result of engine testing. The drive unit is supplied with an engine rotational position signal, an engine speed signal, a fuel demand signal and a timing demand signal and from these signals together with data extracted from the maps, a micro-processor in the drive unit can determine the exact instant at which the current should be supplied to the solenoids and the period of energization in order to secure injection of fuel at the correct instant in the engine operating cycle and in the required quantity. It will of course be understood that the solenoids are energised in turn although for engines having a large number of cylinders two solenoids may be energized at the same time.

The fuel demand signal and the timing demand signal are provided by a microprocessor based engine governor unit. The governor unit receives a power/speed requirement signal from a high level control system and is provided with a number of maps containing data obtained as a result of engine testing. Such data for example, may relate to engine exhaust emissions and specific fuel consumption at different speeds and loads. The governor unit also receives an engine speed signal together with signals relative to other engine operating parameters such for example as engine temperature and air inlet manifold pressure and on the basis of the signals obtained from the engine and the data contained in the maps, the fuel demand signal and the timing demand signal to the drive unit are determined.

A typical application for an engine incorporating the fuel system occurs in a power generation, marine propulsion or rail traction system. In such an application there will be a high level controller which on the basis of operator demand and other inputs determines the power/speed requirement signal which is supplied to the governor unit. The governor unit can also be used to monitor the performance of the engine and both the governor unit and the drive unit will include facilities for checking their operation and the operation of system sensors.

In an engine having a large number of cylinders it is not practical to monitor the speed variation which takes place as a result of the natural fluctuation of torque from each cylinder. However, it is possible to disable the individual fuel systems in turn and then to determine how much extra fuel is required to be supplied to the remaining cylinders to make up for the loss of torque of the disabled cylinder. Clearly if the engine is functioning correctly together with the individual fuel systems, the loss of torque will be the same for each cylinder and no corrective action or warning is required. If however it is found that one or more cylinders is producing less torque than the remaining cylinders, it is possible to extend the closure time of the valve 38 associated with that cylinder to increase the amount of fuel injected to that cylinder. There has to be a limit on the corrective action which can be taken because there may be a mechanical fault in the engine, a fuel system fault, or an electrical fault which requires attention. Assuming that only minor correction is required the practical effect will be a balancing of the torque outputs of the individual engine cylinders and a smoother running engine.

Under some conditions of engine operation, for example light load at both high and low speeds, it may be difficult to control the amount of fuel supplied by the pump. This problem may be overcome by cylinder disabling using the governor unit, and the drive unit to reduce the number of operating cylinders (for example from 16 to 12 or 8) so that the remaining cylinders must receive more fuel to provide the required engine power. In order to maintain the cylinder temperature across the engine, the cylinders may be disabled in turn.

We claim:

1. A fuel system for supplying fuel to a multi-cylinder compression ignition engine comprising:

a fuel injection nozzle for each engine cylinder;

a reciprocable plunger cam actuated pump means for each engine cylinder for supplying fuel to a respective nozzle;

an electromagnetically operable valve means for each engine cylinder for controlling flow of fuel to a respective nozzle; and a control unit for controlling said electromagnetically operable valve means for each engine cylinder;

said pump means comprising, a body having a hollow interior, a step in said hollow interior of said body, a pump barrel in said hollow interior of said body having a flanged portion engaging against said step, a first end and a second end, a bore in said pump barrel having a first end and a second end, a pumping plunger slidably mounted and extending in said bore and having a first end and a second end, said first end being adjacent said first end of said bore, resilient means in said hollow interior of said body between said body and said pumping plunger for biasing said plunger outwardly toward said first end of said bore, means engageable with said pumping plunger for effecting inward movement of said plunger toward said second end of said bore, means for supplying fuel to said bore during outward movement of said plunger, a first valve block in said hollow interior of said body having a first end and a second end, said first end engaging against said second end of said pump barrel, a second valve block in said hollow interior of said body having a first end and a second end, said first end engaging against said second end of said first valve block, a mounting block having a first part extending within said hollow interior of said body and an end on said first part engaging against said second end of said second valve block, means for securing said mounting block to said body for producing a clamping force between said engaging ends of said barrel, valve blocks and mounting block, a spill valve in one of said valve blocks, said electromagnetically operable valve means being mounted on said mounting block and being operatively connected to said spill valve for controlling the operation of said spill valve, a fuel outlet on said mounting block, a fuel delivery channel communicating said second end of said pump barrel with said fuel outlet, and a fuel delivery valve in said fuel delivery channel for controlling the flow of fuel through said fuel delivery channel.

2. The fuel system as claimed in claim 1 wherein:

said spill valve is disposed in said first valve block; and said fuel delivery channel comprises a passage in said first valve block.

3. The fuel system as claimed in claim 2 and further comprising:

a central axis for said pumping plunger;

a spill valve bore in said first valve block, said spill valve being disposed within said spill valve bore;

a delivery valve bore in said second valve block, said delivery valve being disposed in said delivery valve bore; and a cylindrical portion on one end of each of said valve blocks, each cylindrical portion having a central axis coinciding with the axis of the valve bore in the respective valve block, said valve bores in the respective valve block being offset with respect to said central axis of said pumping plunger.

4. A fuel system as claimed in claim 1 wherein said control unit comprises:

a drive unit for said valves comprising look-up maps having data stored therein representing operational times of said electromagnetic drive means and said spill valve for compensating for operating delays due to variations in operating parameters.

5. A fuel system as claimed in claim 4 wherein said drive unit comprises:

a microprocessor for determining the instant of energization and the period of energization of solenoids of said electromagnetic valves of said system in sequence, based on said stored data in said maps and an engine rotational position signal, a fuel demand signal, a fuel timing signal, and an engine speed signal.

6. A fuel system as claimed in claim 5 wherein said control unit further comprises:

a governor unit for supplying said fuel demand signal and said fuel timing signal to said drive unit and including further maps containing stored engine operational data, said governor unit being supplied with signals representing engine operating conditions; and a further microprocessor for determining said fuel demand signal and said fuel timing signal based on signals representing engine operating conditions, a power/speed requirement signal, and said data in said further maps.

7. A fuel system as claimed in claim 6 wherein said control unit further comprises:

a high level controller of a unit of which the engine associated with the fuel system forms a part for supplying said power/speed requirement signal.

8. A fuel system for supplying fuel to a multi-cylinder compression ignition engine comprising:

a fuel injection nozzle for each engine cylinder;

a reciprocable plunger cam actuated pump means for each engine cylinder for supplying fuel to a respective nozzle;

an electromagnetically operable valve means for each engine cylinder for controlling flow of fuel to a respective nozzle; and a control unit for controlling said electromagnetically operable valve means for each engine cylinder;

said pump means comprising, a body having a hollow interior, a step in said hollow interior of said body, a pump barrel in said hollow interior of said body having a flanged portion engaging against said step, a first end and a second end, a bore in said pump barrel having a first end and a second end, a pumping plunger slidably mounted and extending in said bore and having a first end and a second end, said first end being adjacent said first end of said bore, resilient means in said hollow interior of said body between said body and said pumping plunger for biasing said plunger outwardly toward said first end of said bore, means engageable with said pumping plunger for effecting inward movement of said plunger toward said second end of said bore, means for supplying fuel to said bore during outward movement of said plunger, a mounting block having a first part extending within said hollow interior of said body, a first valve block and a second valve block in said hollow interior of said body between said pump barrel and said mounting block, engaging surfaces between said pump barrel, valve blocks and mounting block, means for securing said mounting block to said body for producing a clamping force between said engaging surfaces of said barrel, valve blocks and mounting block, a spill valve in one of said valve blocks, said electromagnetically operable valve means being mounted on said mounting block and being operatively connected to said spill valve for controlling the operation of said spill valve, a fuel outlet on said mounting block, a fuel delivery channel communicating said second end of said pump barrel with said fuel outlet, and a fuel delivery valve in said fuel delivery channel for controlling the flow of fuel through said fuel delivery channel, said spill valve comprising a spill valve bore in said one of said valve blocks and having a first end and second end, a valve seat defined at said first end of said spill valve bore, a spill valve member slidably mounted in said spill valve bore and having a first end and a second end, said spill valve member being shaped at said first end thereof to conform to and cooperate with said valve seat, a reduced diameter portion on said spill valve member at said first end thereof defining a chamber between said spill valve member and said spill valve bore, a spill passage having one end opening into said spill valve bore and a second end communicating with said pump barrel bore, said valve seat surrounding said first end of said spill valve bore between said spill passage and said chamber, restricted flow passage means extending between said spill passage and said second end of said spill valve bore, and means for communicating said second end of said spill valve bore with said electromagnetically operable valve, said electromagnetically operable valve being arranged so that when energized fuel is prevented from escaping through said second end of said spill valve bore whereby said spill valve member moves into engagement with said valve seat to prevent flow through said spill passage, and when de-energized fuel escapes through said second end of said spill valve bore whereby said spill valve member moves out of engagement with said valve seat to allow flow of fuel through said spill passage.

9. The fuel system as claimed in claim 8 and further comprising:

a light spring acting on said spill valve member for biasing said spill valve member towards said first end of said spill valve bore.

10. The fuel system as claimed in claim 8 wherein said means for supplying fuel to said pump barrel bore comprises:

a port formed in the wall of said pump barrel bore communicating with a source of fuel under pressure and being positioned so that said port is opened by said pumping plunger during outward movement of said plunger.

* * * * *